US006099594A

United States Patent [19]

Kümmeler et al.

[11] Patent Number: 6,099,594

[45] Date of Patent: Aug. 8, 2000

[54] SIMULTANEOUS FINISH-STRIPPING AND DYEING OF SYNTHETIC FIBERS

[75] Inventors: Ferdinand Kümmeler; Klaus Walz; Michael Pirkotsch; Josef Pfeiffer, all of Leverkusen; Fritz Lesszinsky, Bergisch Gladbach, all of Germany

[73] Assignee: Bayer Aktiengesellschaft, Leverkusen, Germany

[21] Appl. No.: 09/081,757

[22] Filed: May 20, 1998

[30] Foreign Application Priority Data

May 26, 1997 [DE] Germany ..... 197 21 906
Aug. 25, 1997 [DE] Germany ..... 197 36 923

[51] Int. Cl.[7] ..... D06P 1/647; D06P 1/642; D06P 1/62; D06L 1/12

[52] U.S. Cl. ..... 8/598; 8/602; 8/611; 8/617; 8/907; 8/908; 8/913; 8/914; 8/904; 8/137; 8/137.5; 8/138

[58] Field of Search ..... 8/597, 598–602, 8/586, 611, 617, 907, 913, 914, 908, 904, 582, 137, 137.5, 138

[56] References Cited

U.S. PATENT DOCUMENTS

| | | | |
|---|---|---|---|
| 3,838,967 | 10/1974 | Shepley et al. | 8/111 |
| 4,715,863 | 12/1987 | Navratil et al. | 8/440 |
| 5,152,802 | 10/1992 | Berger et al. | 8/587 |
| 5,540,739 | 7/1996 | Hannemann et al. | 8/552 |

FOREIGN PATENT DOCUMENTS

| | | |
|---|---|---|
| 1519519 | 4/1965 | Germany . |
| 2 079 328 | 1/1982 | United Kingdom . |

OTHER PUBLICATIONS

Chemical Abstracts, vol. 81, No. 14, Oct. 7, 1974, Columbus, Ohio, US; abstract No. 79299, Namiki, Hiroshi et al: "Dyeing textile fabrics composed of polyester fiber" XP002117834, *Zusammenfassung* & JP 48 042274 B (Teijin Ltd.), Dec. 11, 1973.

*Primary Examiner*—Margaret Einsmann
*Attorney, Agent, or Firm*—Joseph C. Gil; Richard E.L. Henderson

[57] ABSTRACT

Synthetic fibers and synthetic fiber textile materials finished with mineral oil finishes, silicone oil finishes or both can be simultaneously stripped of these finishes and dyed in one liquor comprising as essential ingredients a) anionic and/or amphoteric surfactants,
b) dyes, and
c) optionally further compounds selected from the group consisting of the nonionic surfactants, the terpene hydrocarbons/alcohols, sorbitol esters and their alkoxylates, fatty acid ethanolamides, alkylpolyglycosides and solvents.

The treatment is carried out at pH 4.0 to 7.5 at 80–110° C. and at a liquor ratio of 5:1 to 100:1.

7 Claims, No Drawings

SIMULTANEOUS FINISH-STRIPPING AND DYEING OF SYNTHETIC FIBERS

BACKGROUND OF THE INVENTION

The present invention relates to a one-step process for simultaneously finish-stripping and dyeing synthetic fibers or synthetic fiber textile materials finished with mineral oil finishes, silicone oil finishes or both. This is accomplished by treating the fibers or textile materials with an aqueous liquor comprising as essential ingredients a) one or more surfactants selected from the group consisting of the anionic and amphoteric surfactants, b) one or more dyes and c) optionally one or more further compounds selected from the group consisting of the nonionic surfactants, the terpene hydrocarbons, the terpene alcohols and their esters with lower carboxylic acids, the sorbitol esters and their alkoxylates, the fatty acid ethanolamides, the alkylpolyglycosides and the solvents. This treatment is carried out in the pH range from 4.0 to 7.5, at final temperatures within the range of 80–110° C. and at a liquor ratio of 5:1 to 100:1.

Examples of synthetic fibers which can be treated according to the present invention are polyamide fibers, e.g., nylon-6 (Perlon and others) or nylon-6,6, polyester fibers, polyurethane fibers and others known to one of ordinary skill in the art, and their blends with each or one another and their blends with other fibers of vegetable and animal origin. The process of the present invention relates more particularly to fibers composed of polyamides and composed of polyurethanes and to their blends with each or one another and their blends with fibers of vegetable and animal origin, particularly preferably fibers composed of polyamide, polyurethane or polyamide/polyurethane blends. Synthetic fiber textile materials are twisted or otherwise textile-mechanically treated yarns and knits or wovens made thereof. For some applications, for example for the manufacture of socks, combined yarns are used, comprising, for example, a polyurethane fiber and a crimped or uncrimped polyamide fiber.

To improve the processing properties of fibers and yarns produced therefrom, they are provided with a finish, which is then also present on textile materials produced therefrom. In the case of synthetic fibers, the finish is frequently a mineral oil or a silicone oil. However, these oily finishes interfere with the dyeing of fibers, yarns and textile materials through pronounced spotting. Therefore, a mineral oil or silicone oil finish has to be removed by a wash prior to the dyeing process. Such a prewash is known in principle and is carried out in known apparatus. The disadvantage of this separate wash is firstly the time required (about 80–90 min for a wash), the need for separate equipment for this purpose, the personnel required for this separate process, the production of large additional wastewater quantities, which have to be disposed of, and energy requirements for the heating and cooling in this separate operation. The dyeing process cannot be carried out until after the wash, and it has to be carried out with renewed expenditure in terms of the resources mentioned.

SUMMARY OF THE INVENTION

It has now been found that it is possible to carry out the hitherto separate prewash and the dyeing process with one liquor at one and the same time if, as well as one or more dyes, the liquor used includes one or more surfactants selected from the group consisting of the anionic surfactants and amphoteric surfactants and also optionally one or more compounds selected from the group consisting of the nonionic surfactants, the terpene hydrocarbons, the terpene alcohols and their esters with lower carboxylic acids, the sorbitol esters and their alkoxylates, the fatty acid ethanolamides, the alkylpolyglycosides and the solvents.

The present invention accordingly provides a process for simultaneously finish-stripping and dyeing synthetic fibers or synthetic fiber textile materials finished with mineral oil finishes, silicone oil finishes or both, which comprises treating such synthetic fibers or synthetic fiber textile materials with an aqueous liquor comprising as essential ingredients a) one or more surfactants selected from the group consisting of the anionic and amphoteric surfactants, b) one or more dyes selected from the group consisting of the acid dyes, metal complex dyes and disperse dyes, and c) optionally one or more further compounds selected from the group consisting of the nonionic surfactants, the terpene hydrocarbons, the terpene alcohols and their esters with lower carboxylic acids, the sorbitol/mannitol esters and their alkoxylates, the fatty acid ethanolamides, the alkylpolyglycosides and the solvents at a pH within the range from 4.0 to 7.5, at final temperatures in the range of 80–110° C. and at a liquor ratio of 5:1 to 100:1.

DETAILED DESCRIPTION OF THE INVENTION

The process of the present invention accordingly involves dyeing finish-bearing synthetic fibers or textile materials produced therefrom. In this process, the removal of mineral oil or silicone oil finishes or both and the dyeing are effected in one liquor only. The process of the present invention is carried out under the below-specified conditions.

Suitable amphoteric surfactants for the process of the invention are amine oxides, betaines and sulfobetaines containing a $C_{10}$–$C_{22}$-hydrocarbyl radical or mixtures thereof.

Preferred amphoteric surfactants are betaines of the formula $$(C_{10}\text{–}C_{22}\text{-alk(en)yl)-X}\text{—}\overset{\oplus}{N}(R^1,R^2)\text{—}(C_1\text{–}C_4\text{-(hydroxy)alkylene)-COO}^{\ominus}, \quad \text{(I)}$$

where

X is a single bond or the group —CO—NH—($C_2$–$C_3$-alkylene)—, and $R^1$ and $R^2$ are independently of each other hydrogen, methyl or hydroxyethyl.

These betaines include those of the formula $$(C_{10}\text{–}C_{22}\text{-alkyl)}\text{—}\overset{\oplus}{N}(R^1)_2\text{—}CH_2COO^{\ominus}. \quad \text{(II)}$$

Of the amine oxides, preference is given to those of the formula $$(C_{10}\text{–}C_{22}\text{-alk(en)yl)-X}\text{—}\overset{\oplus}{N}(R^1,R^2)\text{→}O^{\ominus} \quad \text{(III)}$$

where

X, $R^1$ and $R^2$ are each as defined above.

Particularly preferred amine oxides are those of the formula

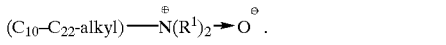

(IV)

Specific examples of suitable betaines (II) are: dodecyl-dimethyl-betaine, cocoalkyl-dimethyl-betaine, tetradecyl-dimethyl-betaine, octadecyl-dimethyl-betaine, tallowalkyl-dimethyl-betaine, oleyl-dimethyl-betaine, cocoalkyl-bis-hydroxyethyl-betaine, stearyl-bis-hydroxyethyl-betaine, tallowalkyl-bis-hydroxyethyl-betaine.

Specific examples of suitable amine oxides (IV) are, for example, dodecyl-dimethyl-amine oxide, cocoalkyl-dimethyl-amine oxide, tetradecyl-dimethyl-amine oxide, octadecyl-dimethyl-amine oxide, tallowalkyl-dimethyl-amine oxide, oleyl-dimethyl-amine oxide, cocoalkyl-bis-hydroxyethyl-amine oxide, stearyl-bis-hydroxyethyl-amine oxide, tallowalkyl-bis-hydroxyethyl-amine oxide.

Suitable anionic surfactants are for example sulfation products of $C_{10}$–$C_{22}$-alkanols, -alkenols or their reaction products with 1–50 units of ethylene oxide (EO), preferably 1–40 units of EO. These sulfated products can be present as alkali metal, alkaline earth metal, ammonium, amine or ethanolamine salts. Further anionic surfactants are soaps of $C_{12}$–$C_{18}$-fatty acids, mersolates and alkylbenzenesulfonic acids which are present in the form of the abovementioned salts. Further suitable anionic surfactants are polyether carboxylates of the formulae $C_8$–$C_{20}$-alk(en)yl—(O—$CH_2$—$CH_2$—)$_x$—O—$CH_2$—COO—M, where X is from 2–30, preferably from 3–10, and M is one equivalent of one of the abovementioned salt-forming cations.

Amphoteric and anionic surfactants of the abovementioned kind are widely used in the field of textile treatment and are known to one of ordinary skill in the art.

By using the aforementioned amphoteric and anionic surfactants and optionally the further compounds, it is possible to remove the mineral oil, silicone oil or mineral/silicone oil finishes on the abovementioned synthetic fibers or textile materials produced therefrom without interfering with the simultaneously conducted dyeing of the synthetic fibers or the textile materials. In fact, surprisingly, dyeings of high uniformity are obtained. Mineral oil finishes are frequently used in the case of polyamide and polyester fibers, whereas silicone oil finishes are frequently used in the case of polyurethane fibers. Mineral oils are for example paraffin oils within the viscosity range of 10–40 mPa.s; silicone oils are for example M-grade oils within the viscosity range of 3–100 mPa.s. It has been found that anionic surfactants remove mineral oil finishes preferentially, whereas amphoteric surfactants are better for the removal of silicone oil finishes. In the case of blend fabrics, for example polyamide/polyurethane or polyester/polyurethane, it is therefore possible to use mixtures of anionic and amphoteric surfactants.

The treatment liquor further comprises dyes, preferably acid dyes, metal complex dyes or disperse dyes. All these dyes are known to one of ordinary skill in the art and require no further elucidation.

The treatment liquor optionally comprises one or more further compounds selected from the group consisting of the nonionic surfactants, the terpene hydrocarbons, the terpene alcohols and their esters with lower carboxylic acids, for example $C_1$–$C_4$-carboxylic acids, preferably acetic acid, the sorbitol/mannitol esters and their alkoxylates, the fatty acid ethanolamides, the alkylpolyglycosides and the solvents.

Nonionic surfactants are for example alcohols, e.g., fat chemistry alcohols or oxo alcohols, or fat chemistry amines or carboxylic acids having 9–13 carbon atoms, which have been reacted with 3–10 units of EO and optionally additionaly with 2–5 units of propylene oxide (PO). Of these reaction products, the alcohols of the aforementioned number of carbon atoms are preferred. Such nonionic surfactants are known to the person of ordinary skill in the art and require no further elucidation.

A terpene hydrocarbon is for example limonene, orange terpene, α-terpinene, balsam terpine oil B, diterpene DS, diterpene B, diterpene A, limonene DL, piperitone, pine oil 70; as terpene alcohols and esters thereof with lower carboxylic acids there may be mentioned for example pineol, terpinyl acetate, terpineol. Sorbitol/mannitol esters are for example those with saturated or unsaturated $C_{12}$–$C_{18}$-fatty acids; their alkoxylates, for example with 2–40 units of EO and optionally 2–10 units of PO, are also possibilities.

Fatty acid ethanolamides have for example an alkyl radical of 12–18 carbon atoms. Alkylpolyglycosides have for example an alkyl radical of 8–12 carbon atoms. Possible solvents are for example isopropanol, methoxypropanol and other solvents known to the person of ordinary skill in the art.

A preferred polyether carboxylate is for example carboxymethylated emulsifiers composed of technical grade lauryl alcohol ($C_{12}$ with fractions to $C_{18}$) with 4 to 8 mol of EO; preferred alkylpolyglycosides have 8–10 carbon atoms; preferred anionic surfactants are $C_{12}$–$C_{18}$-alkyl sulfates with 0–40 units of ethylene oxide. Preferred nonionic surfactants are $C_9$–$C_{13}$-alcohols with 3–10 units of ethylene oxide. Preferred fatty acid ethanolamides are mixtures having alkyl radicals of 12–18 carbon atoms.

The treatment baths of the present invention utilize the following amounts of the compounds mentioned:

a) anionic and/or amphoteric surfactants in an amount of 0.05–2 g/l of washing/dyeing liquor, preferably 0.1–1 g/l, in a weight ratio of 9:1–1:9 when both anionic and amphoteric surfactants are used;

b) 0.01–1 g/l of one or more dyes for a wide range of different depth of shade, preferably 0.03–0.3 g/l;

c) 0–1 g/l of anionic surfactant and/or 0–1 g/l of terpene hydrocarbons/terpene alcohols/their esters and/or 0–1 g/l of sorbitol ester/mannitol ester/their alkoxylates and/or 0–2 g/l of fatty acid ethanolamides and/or 0–1 g/l of alkylpolyglycosides and/or 0–2 g/l of solvent.

If ready-to-use mixtures/combinations of surfactants a) and further compounds c) are available, such mixtures/combinations may be used in an amount of 0.5 to 3 g per liter of liquor as well as the dyes.

Typical liquor batches on that basis are, then, for example (without dyes)

| | | | |
|---|---|---|---|
| 0.2 g/l | of amphoteric surfactant (I) or | 0.4 g/l | of alkylpoly-glucoside |
| 0.2 g/l | of anionic surfactant (I) | 0.4 g/l | of anionic surfactant (I) |
| 0.06 g/l | of limonene | 0.2 g/l | of fatty acid mono-ethanolamide |
| 0.06 g/l | of nonionic surfactant | balance | water |
| 0.06 g/l | of solvent | | |
| balance | water | | |

The treatment of the present invention of finish-bearing synthetic fibers or synthetic fiber textile materials for the purpose of effecting dyeing at the same time is carried out in the pH range from 4.0 to 7.5, at final temperatures within the range of 80–110° C. and at liquor ratios of 5:1 to 100:1, preferably 5:1 to 10:1. Customary apparatus is used, such as open-width washers, drum dyeing machines, cotton washers and cotton dyeing machines. The final temperatures are reached following heating from room temperature. Heating rates used range from 0.5 to 8° C./min.

Preferred combinations of surfactants a) and further compounds c) for use in the treatment liquor as well as the dye or dyes are:

(i) betaines or amine oxides, anionic surfactants, one or more nonionic surfactants and with or without terpene hydrocarbons/alcohols and also with or without solvents, or (ii) betaines or amine oxides, anionic surfactants, one or more nonionic surfactants and with or without fatty acid ethanolamides.

EXAMPLES

Examples 1–41 and I–IV

Inventive combinations of surfactants a) and further compounds c) for simultaneous dyeing according to the present invention (preliminary experiments here, without dyes); the last column of the table reports the residual finish content (as petroleum ether (PE) extract) remaining after the liquor treatment of the present invention compared with untreated raw material. The raw material is socks composed of polyamide/polyurethane blend fiber. Examples I to IV utilize raw materials having different original finish contents, and the remaining finish content is reported. The reported compositions are concentrates with the reported parts as parts by weight or in % by weight. Each concentrate is used in an amount of 1 g/l of wash liquor.

Key to designations in tables:

Betaine 1=tallow-bis(hydroxyethyl)-betaine of the formula (II)

Surfactant A=cetylaminomethylphenol with 15 mol of EO

Surfactant B=$C_{12}$–$C_{18}$-alcohol with 3 0 mol of EO, sulfated, sodium salt Surfactant C=mixture of i-tridecanol with 3 mol of EO and i-tridecanol with 9 mol of EO Betaine 2=dimethyl cocoamine reacted with $ClCH_2COONa$ to form betaine of formula (II)

Surfactant D=carboxymethylated lauryl alcohol with 11 mol of EO

Surfactant E=i-tridecyl alcohol with 4 mol of EO

Surfactant F=dodecylbenzenesulfonic acid, calcium salt (67 parts in 33 parts of n-butanol)

Surfactant G=carboxymethylated lauryl alcohol with 6 mol of EO

Surfactant H=dodecyl sulfate aminoethanol salt in cyclohexanol/methoxypropanol

Surfactant I=polyethersiloxane (Tegopren 5878 from Th. Goldschmidt)

Surfactant J=alkylpolyglycoside (continued after tables)

SOCK WASHING COMPOSITIONS

| Example No. | made up of surfactants a) and further compounds c) | Socks PE extract |
|---|---|---|
| I Raw material | | 2.42 |
| 1 | 2.6 p of lactic acid, 64 p of betaine, 8 p of methoxypropanol, 8 p of limonene, 16 p of surfactant A, 1.4 p of $H_2O$ | 1.66 |
| 2 | 1.3 p of lactic acid, 64 p of betaine, 8 p of methoxypropanol, 8 p of limonene, 1.6 p of surfactant A, 2.7 p of $H_2O$ | 1.76 |
| 3 | 17.6 p of limonene, 30.3 p of betaine, 10.1 p of methoxypropanol, 30.3 p of surfactant B, 1.6 p of lactic acid, 10.1 p of surfactant A | 1.74 |

-continued

SOCK WASHING COMPOSITIONS

| Example No. | made up of surfactants a) and further compounds c) | Socks PE extract |
|---|---|---|
| 4 | 5.6 p of orange terpene, 16.7 p of betaine; 5.6 p of methoxypropanol, 16.7 of surfactant B, 5 p of lactic acid; 5.6 p of surfactant C, 44.8 p of $H_2O$ | 1.59 |
| 5 | 5.7 p of terpinyl acetate K, 17 p of betaine, 5.7 p of methoxypropanol. 17 p of surfactant B, 4 p of lactic acid, 5.7 p of surfactant C, 44.9 p of $H_2O$ | 1.41 |
| 6 | 5.8 p of alpha terpinene, 17.3 p of betaine, 5.8 p of methoxypropanol, 17.3 of surfactant B; 2.2 p of lactic acid, 5.8 p of surfactant C, 45.8 p of $H_2O$ | 1.36 |
| 7 | 5.7 p of balsam terpine oil B, 17.2 p of betaine, 5.7 p of methoxypropanol, 17.2 p of surfactant B, 2.5 p of lactic acid, 5.7 p of surfactant C, 46.0 p of $H_2O$ | 1.33 |
| 8 | 5.8 p of dipentene DS, 17.3 p of betaine, 5.8 p of methoxypropanol, 17.3 p of surfactant B, 2.2 p of lactic acid, 5.8 p of surfactant C, 45.8 p of $H_2O$ | 1.35 |
| 9 | 5.6 p of dipentene B, 16.7 p of betaine; 5.6 p of methoxypropanol, 16.7 p of surfactant B, 5 p of lactic acid, 5.6 p of surfactant C, 44.8 p of $H_2O$ | 1.35 |
| 10 | 5.8 p of dipentene A, 17.3 p of betaine, 5.8 p of methoxypropanol, 17.3 p of surfactant B, 2.2 p of lactic acid, 5.8 p of surfactant C, 45.8 p of $H_2O$ | 1.30 |
| 11 | 5.7 p of limonene DL, 17.2 p of betaine, 5.7 p of methoxypropanol, 17.2 p of surfactant B, 2.5 p of lactic acid, 5.7 p of surfactant C, 46.0 p of $H_2O$ | 1.26 |
| 12 | 5.7 p of orange oil terpene, 17.2 p of betaine, 5.7 p of methoxypropanol, 17.2 p of surfactant B, 2.5 p of lactic acid, 5.7 p of surfactant C, 46.0 p of $H_2O$ | 0.99 |
| 13 | 5.4 p of piperitone, 17 p of betaine, 5.4 p of methoxypropanol, 17 p of surfactant B, 7.6 p of lactic acid, 5.7 p of surfactant C, 43.1 p of $H_2O$ | 1.24 |
| 14 | 5.4 p of pine oil 70 C, 16.3 p of betaine, 5.4 p of methoxypropanol, 16.3 p of surfactant B, 7.8 p of lactic acid, 5.4 p of surfactant C, 43.4 p of $H_2O$ | 1.52 |
| 15 | 5.4 p of terpineol, 16.3 p of betaine, 5.4 p of methoxypropanol, 16.3 p of surfactant B, 7.8 p of lactic acid, 5.4 p of surfactant C, 43.4 p of $H_2O$ | 1.58 |
| II Raw material | | 3.76 |
| 16 | 19.7 p of betaine 2, 5.9 p of methoxypropanol, 5.9 p of limonene, 17.6 p of surfactant B, 5.9 p of surfactant C, 45.0 p of $H_2O$ | 1.58 |
| III Raw material | | 5.35 |
| 16a | 19.7 p of betaine 2, 5.9 p of methoxypropanol, 5.9 p of limonene, 17.6 p of surfactant B, 5.9 p of surfactant C, 45.0 p of $H_2O$ | 2.08 |

| No. | Composition | g/l used | % PE extr. | % Si removed |
|---|---|---|---|---|
| | | | pH 4.5/98° C. dyebath | |
| 17 | 50% of surfactant D, 50% of surfactant E | 0.84 DAS | 1.43 | |
| 18 | 50% of surfactant D, 50% of surfactant F | " | 1.37 | |
| 19 | 41.7% of surfactant D, 41.7% of surfactant E, 13.3% of mineral oil (from Esso), 3.3% of polydimethylsiloxane | " | 1.54 | |
| 20 | 50% of surfactant G, 50% of surfactant F | " | 1.56 | |
| 21 | 50% of surfactant E, 50% of surfactant H | " | 1.65 | |

-continued

| No. | Composition | g/l used | % PE extr. | % Si removed |
|---|---|---|---|---|
| 22 | 50% of surfactant I, 50% of surfactant H | " | 1.35 | |
| 23 | 50% of surfactant J, 50% of surfactant H | " | 1.22 | |
| 24 | 50% of surfactant D, 50% of surfactant F (repeat of No. 18) | " | 1.56 | |
| 25 | 8% of sorbitan laurate, 8% of surfactant D, 4% of Na laurate, 8% of isopropanol, $H_2O$ (72%) | " | 1.66 | |
| 26 | 8% of sorbitan stearate, 8% of surfactant D, 4% of Na laurate, 8% of isopropanol, $H_2O$ (72%) | " | 1.53 | |
| 27 | 44.1% of surfactant E; 44.1% of surfactant H, 11.8% of techn. lauryl alcohol ($C_{12}$–$C_{18}$) | " | 1.71 | |
| 28 | 28.6% of sorbitan oleate, 28.6% of surfactant D, 14.3% of Na laurate, 28.6% of surfactant H | " | 1.94 | |
| 29 | 30.8% of sorbitan oleate, 30.8% of surfactant K, 15.4% of Na laurate. 15.4% of surfactant L, 7.7% of isopropyl lactate | " | 2.28 | |
| 30 | 50% of surfactant M, 50% of surfactant F | " | 1.29 | |
| 31 | 66.7% of surfactant M, 33.3% of surfactant F (50% conversion of surfactant M) | " | 1.40 | |
| 32 | 29.1% of sorbitan oleate, 29.1% of surfactant K, 14.5% of Na laurate, 18.2% of surfactant N, $H_2O$ (9.1%) | " | 1.76 | |
| 33 | Surfactant M | " | 1.50 | |
| 34 | 66.7% of surfactant M, 33.3% of surfactant F (62% conversion of surfactant M) | " | 1.41 | |
| 35 | 80% of surfactant M, 20% of surfactant F | " | 1.41 | |
| | | | pH 4.5/80° C. prewash | |
| | | | 2.45 | |
| IV Raw material | | | | |
| 36 | Octadecyldimethylamine oxide, 40% strength in isopropanol/$H_2O$ | 1 | 1.08 | 84 |
| 37 | Lauryldimethylaminebetaine, demineralized, 22% strength in $H_2O$ | 1 | 1.4 | 67 |

-continued

| No. | Composition | g/l used | % PE extr. | % Si removed |
|---|---|---|---|---|
| 38 | 16.5% of lauryldimethylamine oxide/25% of surfactant L/58.5 % of $H_2O$ | 1 | 1.67 | 69 |
| 39 | 19.5% of octadecyldimethyl-aminebetaine/9.5% of isobutanol/3.2% of NaCl/ 57.8% mixture of $H_2O$/isopropanol | 1 | 1.24 | 81 |
| 40 | 40% of surfactant O/40% of surfactant H/20% of surfactant P | 1 | 1.61 | 86 |
| 41 | 20% of surfactant O/60% of surfactant H/20% of surfactant L | 1 | 1.53 | 74 |

Surfactant K = Marlowet 1072
Surfactant L = ethylhexyl alcohol with 6 mol of PO
Surfactant M = carboxymethylated mixture (1:1) of lauryl alcohol with 5 mol of EO and with 7 mol of EO
Surfactant N = nonyl/undecyl alcohol with 5 mol of EO and 5 mol of PO, respectively
Surfactant O = Glucopon (65% strength)
Surfactant P = $C_{12}$–$C_{18}$-fatty acid monoethanolamide
DAS = detergent-active substance

Example 42

Sock Dyeing (existing process)

Material: Polyamide/polyurethane

Machine: Drum dyeing machine (Dröll & Lohmann) with liquor injection and 700 liters liquor capacity Liquor ratio: 10:1 on the basis of 70 kg of material.

Prewash:

1 g/l of surfactant N
1 g/l of calcined sodium carbonate
Starting temperature: 25° C.
Heating-up rate: 4° C./min
Maximum temperature: 80° C.
Treatment time: 15'
Liquor drainage
1st rinse bath at 40° C.
dropping/spinning down
2nd rinse bath at 40° C.
dropping/spinning down
Total time: 80–90 min

| Dyeing | | | | | |
|---|---|---|---|---|---|
| 0.5 g/l | of defoamer mixture with mineral oil | | | | |
| 1 g/l | of tallowsulfonate, Na salt, with oleyl alcohol with 19 EO | | | | |
| 4% | of leveler composed of alkylaminomethylphenol with 15 EO and condensate of nonylphenol, formaldehyde and hexamethylenediamine with 60 mol of EO | | | | |
| 0.5 g/l | of monosodium phosphate | } pH 6.5 | | | |
| 0.25 ml/l | of acetic acid 80% | | | | |
| 0.004% | of Telon Yellow 3RL micro | or | A.Y. 240 | or | A.Y. 242 = Yellow A3RL |
| 0.002% | of Telon Red FRL micro | | A.R. 337 | | A.R. 299 = Rubine ASB |
| 0.0021% | of Telon Blue BRL micro | | A.B. 324 | | A.B. 264 = Blue AFN |

Starting temperature: 25° C.

-continued

| Dyeing | | |
|---|---|---|
| Heating rate | 1° C./min | 73 min |
| Maximum temperature | 98° C. | |
| Dyeing time at 98° C.: 30 min, | | +30 min |
| Cooling, dropping, rinsing, possible after treatment for fastness improvement, finishing. | | |
| Total time: 103–120 min | | |

Example 43

Sock Dyeing (inventive process)

Material: Polyamide/polyurethane

Machine: Drum dyeing machine (Dröll & Lohmann) with liquor injection and 700 liters liquor capacity Liquor ratio: 10:1 on the basis of 70 kg of material

| Washing and dyeing (single bath) | |
|---|---|
| 1 g/l | of inventive composition according to Example 16 |
| 0.5 g/l | of defoamer mixture with mineral oil |
| 1 g/l | of tallowsulfonate, sodium salt with oleyl alcohol with 19 EO |
| 4% | of leveler as in Example 42 |
| 0.5 g/l | of monosodium phosphate |
| 0.25 ml/l | of acetic acid 80% |
| 0.004% | of Telon Yellow 3RL micro |
| 0.002% | of Telon Red FRL micro |
| 0.0021% | of Telon Blue BRL micro |

Starting temperature: 25° C.

Heating rate: 1° C./min

Maximum temperature: 98° C.

Dyeing time at 98° C.: 30 min, +30 min

Cooling, dropping, rinsing, possible aftertreatment for fastness improvement, finishing. Total time: 103–120 min; saving 80–90 min

What is claimed is:

1. A process comprising simultaneously finish-stripping and dyeing finished synthetic fibers or finished synthetic fiber textile materials that have been finished with mineral oil finishes and/or silicone oil finishes with an aqueous liquor comprising a) a mixture of one or more anionic surfactants and one or more amphoteric surfactants, b) one or more dyes selected from the group consisting of acid dyes, metal complex dyes, and disperse dyes, c) optionally, one or more compounds selected from the group consisting of nonionic surfactants, terpene hydrocarbons, terpene alcohols, sorbitol/mannitol esters and alkoxylates thereof, fatty acid ethanolamides, and alkylglycosides, and d) optionally, solvents other than compounds of component (c), at a pH within the range of from 4.0 to 7.5, a final temperature in the range of from 80 to 110° C., and a ratio of liquor to finished synthetic fiber or finished synthetic fiber textile material of 5:1 to 100:1.

2. The process of claim 1 wherein the ratio of liquor to synthetic fiber or synthetic fiber textile material is from 5:1 to 10:1.

3. The process of claim 1 wherein the amphoteric surfactant is a betaine of the formula $$(C_{10}\text{–}C_{22}\text{-alk(en)yl)-X}\text{—}\overset{\oplus}{N}(R^1,R^2)\text{—}(C_1\text{–}C_4\text{-(hydroxy)alkylene)-COO}^{\ominus}$$

wherein

X is a single bond or the group —CO—NH—($C_2$–$C_3$-alkylene)—, and $R^1$ and $R^2$ are independently of each other hydrogen, methyl, or hydroxyethyl.

4. The process of claim 1 wherein the amphoteric surfactant is a betaine of the formula $$(C_{10}\text{–}C_{22}\text{-alkyl)}\text{—}\overset{\oplus}{N}(R^1)_2\text{—}CH_2\text{—}COO^{\ominus}$$

wherein $R^1$ is hydrogen, methyl, or hydroxyethyl.

5. The process of claim 1 wherein the amphoteric surfactant is an amine oxide of the formula $$(C_{10}\text{–}C_{22}\text{-alk(en)yl)-X}\text{—}\overset{\oplus}{N}(R^1,R^2)\text{→}O^{\ominus}$$

wherein

X is a single bond or the group —CO—NH—($C_2$–$C_3$-alkylene)—, and $R^1$ and $R^2$ are independently of each other hydrogen, methyl, or hydroxyethyl.

6. The process of claim 1 wherein the amphoteric surfactant is an amine oxide of the formula $$(C_{10}\text{–}C_{22}\text{-alkyl)}\text{—}\overset{\oplus}{N}(R^1)_2\text{→}O^{\ominus}$$

wherein $R^1$ is hydrogen, methyl, or hydroxyethyl.

7. The process of claim 1 wherein the aqueous liquor comprises a dye (b) and a combination of surfactants (a) and compounds (c) consisting essentially of (i) a betaine or amine oxide, an anionic surfactant, and one or more nonionic surfactants; or (ii) a betaine or amine oxide, an anionic surfactant, one or more nonionic surfactants, and one or more components selected from the group consisting of terpene hydrocarbons, terpene alcohols, and solvents other than terpene hydrocarbons and terpene alcohols; or (iii) a betaine or amine oxide, an anionic surfactant, one or more nonionic surfactants, and a fatty acid ethanolamide.

* * * * *